US010914533B2

(12) United States Patent
Somhorst et al.

(10) Patent No.: US 10,914,533 B2
(45) Date of Patent: Feb. 9, 2021

(54) INTERCOOLER FOR IMPROVED DURABILITY

(71) Applicant: Hanon Systems, Daejeon (KR)

(72) Inventors: Leo Somhorst, Lower Camden (GB); Petr Fabian, Studenka (CZ); Stephen Joyce, Surrey (GB); Marek Bursik, Jicin (CZ); Martin Sopuch, Zenklava (CZ); Stepan Hlavac, Veseli Nad Moravou (CZ); Jan Povysil, Prerov (CZ); Durai Duraiswamy, Canton, MI (US)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 15/914,235

(22) Filed: Mar. 7, 2018

(65) Prior Publication Data

US 2018/0274867 A1 Sep. 27, 2018

Related U.S. Application Data

(60) Provisional application No. 62/476,316, filed on Mar. 24, 2017.

(51) Int. Cl.

| | |
|---|---|
| ***F28F 3/04*** | (2006.01) |
| ***F28F 3/08*** | (2006.01) |
| ***F28D 1/03*** | (2006.01) |
| ***F28D 9/00*** | (2006.01) |
| ***F28F 3/02*** | (2006.01) |
| *F28D 21/00* | (2006.01) |

(52) U.S. Cl.

CPC ..... *F28F 3/042* (2013.01); *F28D 1/0333* (2013.01); *F28D 9/0093* (2013.01); *F28F 3/025* (2013.01); *F28F 3/08* (2013.01); *F28D 1/0341* (2013.01); *F28D 2021/0094* (2013.01); *F28F 2215/04* (2013.01); *F28F 2225/04* (2013.01); *F28F 2225/08* (2013.01); *F28F 2265/26* (2013.01)

(58) Field of Classification Search

CPC ..... F28F 3/044; F28F 3/086
USPC ..... 165/153, 167
See application file for complete search history.

(56) References Cited

U.S. PATENT DOCUMENTS 2,677,531 A * 5/1954 Hock, Sr. ..... F28F 3/083 165/167
4,535,839 A * 8/1985 Sacca ..... F28D 1/0333 165/153
4,708,199 A * 11/1987 Yogo ..... F28D 9/0012 165/167

(Continued)

FOREIGN PATENT DOCUMENTS

EP 0548360 A1 6/1993
JP H06117783 A 4/1994

(Continued)

OTHER PUBLICATIONS

German Office Action dated Nov. 25, 2020.

*Primary Examiner* — Leonard R Leo
(74) *Attorney, Agent, or Firm* — Shumaker, Loop & Kendrick, LLP; James D. Miller

(57) ABSTRACT

A plate for a heat exchanger includes a substantially planar body having a first end, a second end opposing the first end, a fluid surface, and an outer surface. A first cup extends from the outer surface of the body adjacent the first end of the body. A second cup extends from the outer surface of the body and is spaced from the second end of the body.

17 Claims, 12 Drawing Sheets

(56) References Cited

U.S. PATENT DOCUMENTS

| | | | | |
|---|---|---|---|---|
| 5,014,775 | A * | 5/1991 | Watanabe | F28D 9/0012 165/167 |
| 5,078,209 | A * | 1/1992 | Kerkman | F28D 9/0012 165/167 |
| 5,125,453 | A * | 6/1992 | Bertrand | F28D 1/0341 165/153 |
| 5,634,518 | A * | 6/1997 | Burgers | F28D 1/0333 165/153 |
| 6,199,626 | B1 * | 3/2001 | Wu | F28D 9/0012 165/166 |
| 6,702,006 | B2 * | 3/2004 | Holm | F28D 9/005 165/166 |
| 7,040,387 | B2 * | 5/2006 | Leuthner | F28D 9/005 165/167 |
| 7,677,301 | B2 | 3/2010 | Blomgren | |
| 9,631,876 | B2 * | 4/2017 | Zima | F28F 3/08 |
| 2010/0175858 | A1 | 7/2010 | Miao et al. | |
| 2013/0213621 | A1 | 8/2013 | Pierre et al. | |
| 2014/0216702 | A1 | 8/2014 | Vallee et al. | |

FOREIGN PATENT DOCUMENTS

| | | | |
|---|---|---|---|
| JP | 2016148491 | A | 8/2016 |
| KR | 20140114770 | A | 9/2014 |

* cited by examiner

INTERCOOLER FOR IMPROVED DURABILITY

CROSS-REFERENCE TO RELATED APPLICATIONS

This patent application claims the benefit of U.S. Provisional Patent Application Ser. No. 62/476,316, filed on Mar. 24, 2017. The entire disclosure of the above patent application is hereby incorporated herein by reference.

FIELD OF THE INVENTION

The invention relates generally to a plate heat exchanger, and more particularly, to a plate and fin assembly configured to maximize durability of the plate heat exchanger.

BACKGROUND

As commonly known, coolant systems are employed in vehicles to cool air flowing through an engine air circuit, and thus an engine, of a vehicle. Cooler air will have an increased density that maximizes an efficiency of the engine and militates against excessive wear or heat damage to the engine. Coolant pumps cause coolant to flow through the coolant system. Heat exchangers are employed in the coolant system to transfer heat between the air flowing through the engine air system and the coolant flowing through the coolant system. The heat exchangers include a heat exchange core with plate assemblies interposed between fins. The plate assemblies include a pair of plates defining a flow path for the coolant to flow. The air of the engine air circuit flows intermediate adjacent ones of the plate assemblies through the fins.

As vehicle manufacturers continue to push for improved system efficiency, one solution has been to utilize intermittent operation of the coolant systems, wherein the coolant pumps are deactivated when heat exchange is unnecessary or when the air flowing through the engine air circuit does not need to be cooled. By deactivating the coolant pumps, a temperature of the air flowing through the engine air circuit can be controlled. Controlling the temperature of the air militates against condensation forming on components of the engine air circuit and may improve fuel efficiency when the vehicle is performing under certain loads.

Although effective in minimizing energy usage, the intermittent operation of the coolant systems causes larger temperature fluctuations throughout the heat exchanger compared to continuously operated coolant systems. These large temperature fluctuations result in thermal stresses within the coolant systems, and particularly through the plate assembly and fin heat exchanger core of the heat exchanger. As a result, the temperature fluctuations may result in undesirable operation of the heat exchanger over time due to fatigue-related issues.

The plate assemblies are connected to each other and are not suited to accommodate large variations in thermal expansion and contraction caused by the temperature fluctuations resulting from the intermittent operation of the coolant systems. For example, higher thermal stresses typically occur at, proximate to, or adjacent coolant openings of the plate assemblies forming manifolds of the heat exchange core. Additionally, increased thermal stresses also occur at a side of the plate assemblies adjacent a warmer side of the heat exchanger or adjacent an air inlet side of the heat exchanger. Typically, the fins engage and extend along a length of a portion of the plate assemblies but do not extend along an entire length of the plate assemblies. For example, the fins typically only engage a middle portion of the plates with respect to the length, wherein the ends of the fins are spaced from end portions of the plate assemblies which typically include the openings of the plates. The fins of the heat exchanger core typically provide minimal, if any, support to the plate assemblies in the regions of the plate assemblies subjected to the increased thermal stresses (i.e. proximate the openings of the plate assemblies and/or the sides of the plate assemblies adjacent the air inlet). Accordingly, there is a continuing need in the automotive vehicle industry to maximize durability of the heat exchangers of the coolant systems.

Accordingly, there exists a need in the art for a heat exchanger which minimizes stresses induced by variations in thermal expansion and contraction, and more particularly, a heat exchanger with a heat exchange core providing maximized fatigue life.

SUMMARY OF THE INVENTION

In concordance with the instant disclosure, a heat exchanger which minimizes stresses induced by variations in thermal expansion and contraction, and more particularly, a heat exchanger with a heat exchange core providing maximized fatigue life has been surprisingly discovered.

According to an embodiment of the disclosure, a plate for a heat exchanger is disclosed. The plate includes a substantially planar body having a first end, a second end opposing the first end, a fluid surface, and an outer surface. A first cup extends from the outer surface of the body adjacent the first end of the body. A second cup extends from the outer surface of the body and is spaced from the second end of the body.

According to yet another embodiment of the disclosure, a plate and fin assembly for a heat exchanger is disclosed. The plate and fin assembly includes a plate having a fluid surface, an outer surface, a first end, a second end, a first cup extending outwardly from the outer surface, and a second cup extending outwardly from the outer surface. A fin engages the outer surface of the plate. The fin has a louvre region and a non-louvre region. The non-louvre region engaging the plate adjacent the first cup with respect to a width of the plate. The louvre region engaging the plate intermediate the first cup and the second cup with respect to a length of the plate.

A plate and fin assembly for a heat exchanger includes a plate having a fluid surface, an outer surface, a first end, a second end, a first cup, and a second cup. The plate includes a plurality of protrusions extending outwardly from the fluid surface of the plate. A fin engages the outer surface of the plate and includes a first cutout portion and a second cutout portion. The first cutout portion receiving the first cup and the second cutout portion receiving the second cup.

BRIEF DESCRIPTION OF THE DRAWINGS

The above objects and advantages of the invention, as well as others, will become readily apparent to those skilled in the art from reading the following detailed description of a preferred embodiment of the invention when considered in the light of the accompanying drawings, in which.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
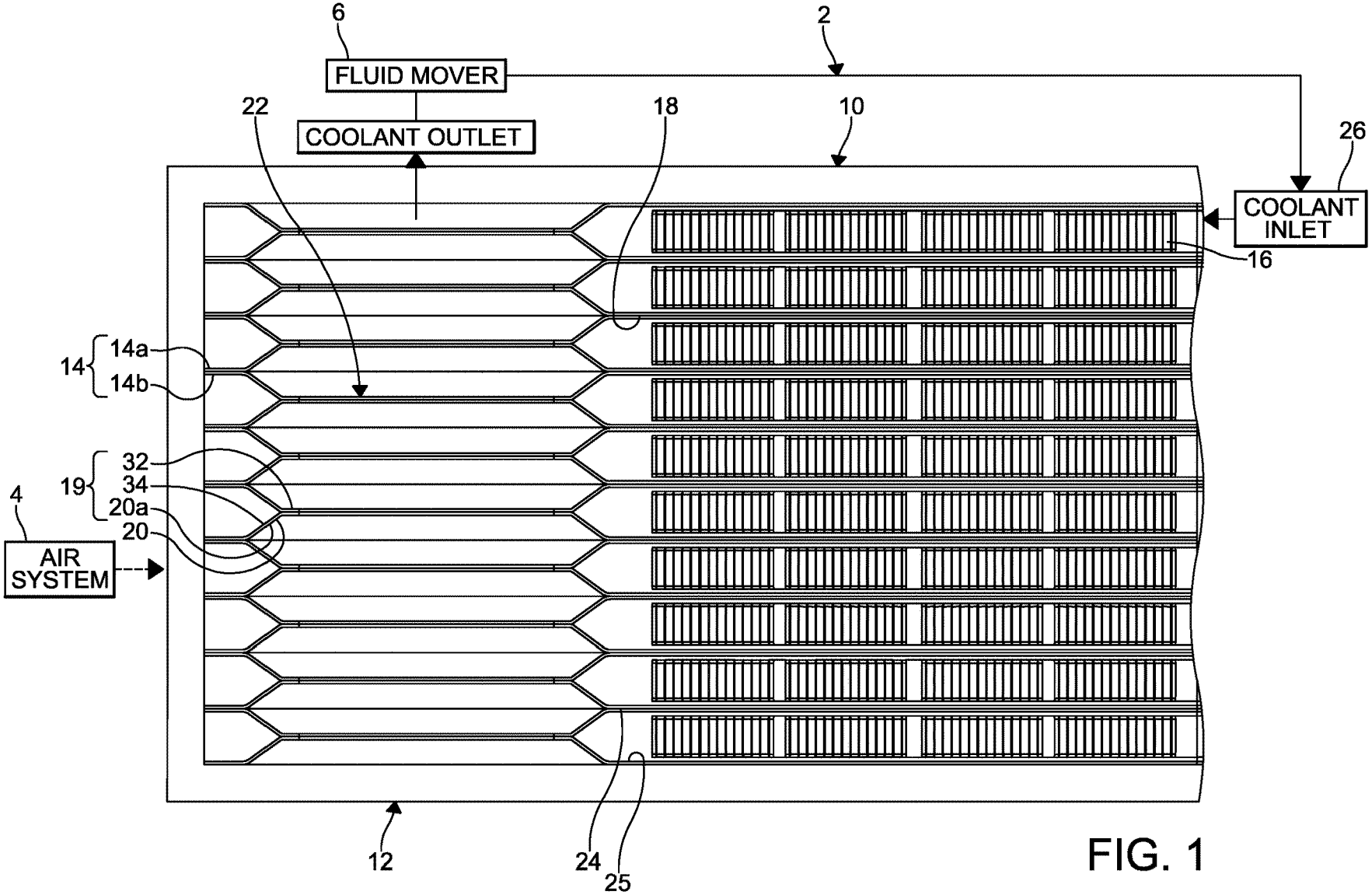
FIG. 1 is a schematic fragmentary cross-sectional elevational view of a heat exchanger according to an embodiment of the present disclosure, wherein a heat exchange core receiving air from an air system and a coolant from a coolant system is illustrated.

In FIG. 1, a heat exchanger 10 according to the instant disclosure is shown. The heat exchanger 10 is configured to receive a coolant from a coolant system 2 of a vehicle and air from an air system 4 of the vehicle. The coolant system 2 conveys the coolant from one or more coolant sources through the heat exchanger 10 and includes a fluid mover 6 such as a pump, for example, for conveying the coolant through the coolant system 2. The air system 4 is in fluid communication with an engine (not shown) of the vehicle. A direction of a flow of coolant through the heat exchanger 10 is indicated by a solid arrow and a direction of a flow of air through the heat exchanger 10 is indicated by a dashed arrow.

The heat exchanger 10 is configured to transfer heat between the coolant and the air flowing therethrough. The heat exchanger 10 is configured as a plate heat exchanger, described in further detail below. For example, the heat exchanger 10 is configured as a water-cooled charge air cooler, for example. However, the heat exchanger 10 can be configured as other types of plate heat exchangers without departing from the scope of the disclosure. The coolant system 2 is configured to intermittently cycle between an operating mode and an inoperative mode. In the operating mode, the fluid mover 6 is operating and causes the coolant to flow through the coolant system 2 and, thus, through the heat exchanger 10. In the inoperative mode, the fluid mover 6 is not operating and the coolant is caused to move through the coolant system 2. The coolant system 2 cycles between the operating mode and the inoperative mode to thermally control the coolant system 2.

The heat exchanger 10 includes a heat exchange core 12. The heat exchange core 12 includes a plurality of plate assemblies 14 and fins 16 interposed between the plate assemblies 14. Each of the plate assemblies 14 is formed from a first plate 14*a* and a second plate 14*b*. The first plate 14*a* and the second plate 14*b* are stacked fluid surface 24 to fluid surface 24 to form a flow channel 18 therebetween. Cups 19 extend from an outer surface 25 of each of the plates 14*a*, 14*b*. Each of the cups 19 includes a collar 34 defining an aperture 20 terminating in a planar rim 32. The cups 19 cooperate to define manifolds 22 of the heat exchanger 10 when the plate assemblies 14 are stacked together. An inlet one of the manifolds 22 conveys the coolant from a coolant inlet 26 to the flow channels 18 of the plate assemblies 14 and an outlet one of the manifolds 22 conveys the coolant from the flow channels 18 of the plate assemblies 14 to a coolant outlet 28. The plates 14*a*, 14*b* of each of the plate assemblies 14 are coupled to each other by brazing, for example. Although, other coupling means such as welding, stamping, bolting, pinning, or any other coupling means can be employed to couple the plates 14*a*, 14*b* together.

Each of the fins 16 of the heat exchanger 10 is disposed intermediate adjacent ones of the plate assemblies 14 within a space receiving the air from the air system 4, wherein the air flows through the fins 16. Each of the fins 16 engages an outer surface 25 of the adjacent ones of the plate assemblies 14. The fins 16 are configured to maximize a transfer of heat between the coolant flowing through the flow channels 18 of the plate assemblies 14 and the air flowing through the fins 16. A further description of the fins 16 is described in further detail herein below.

Figure 2:
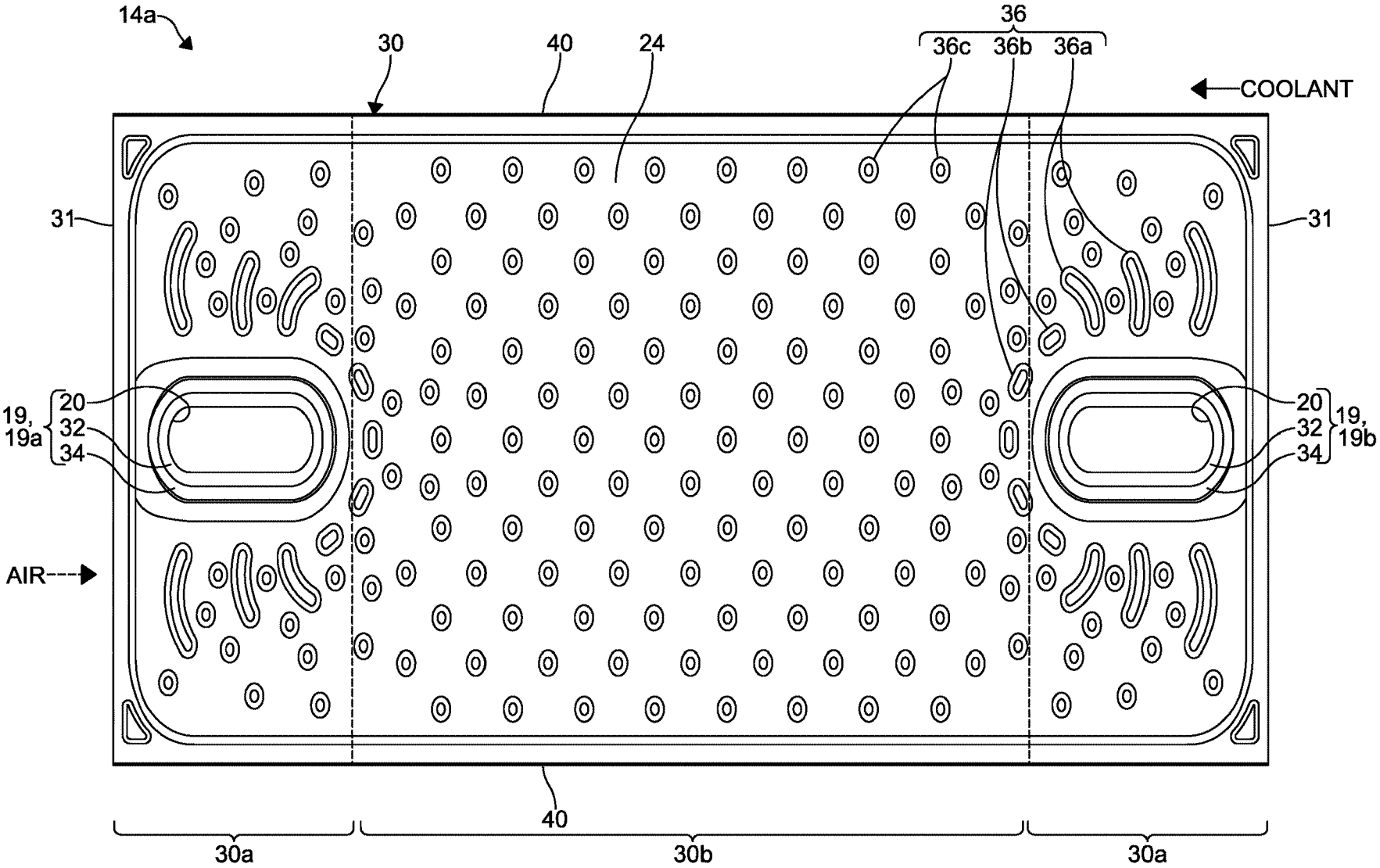
FIG. 2 is a top plan view of a first plate of a plate assembly of the heat exchanger of FIG. 1.
Figure 3A:
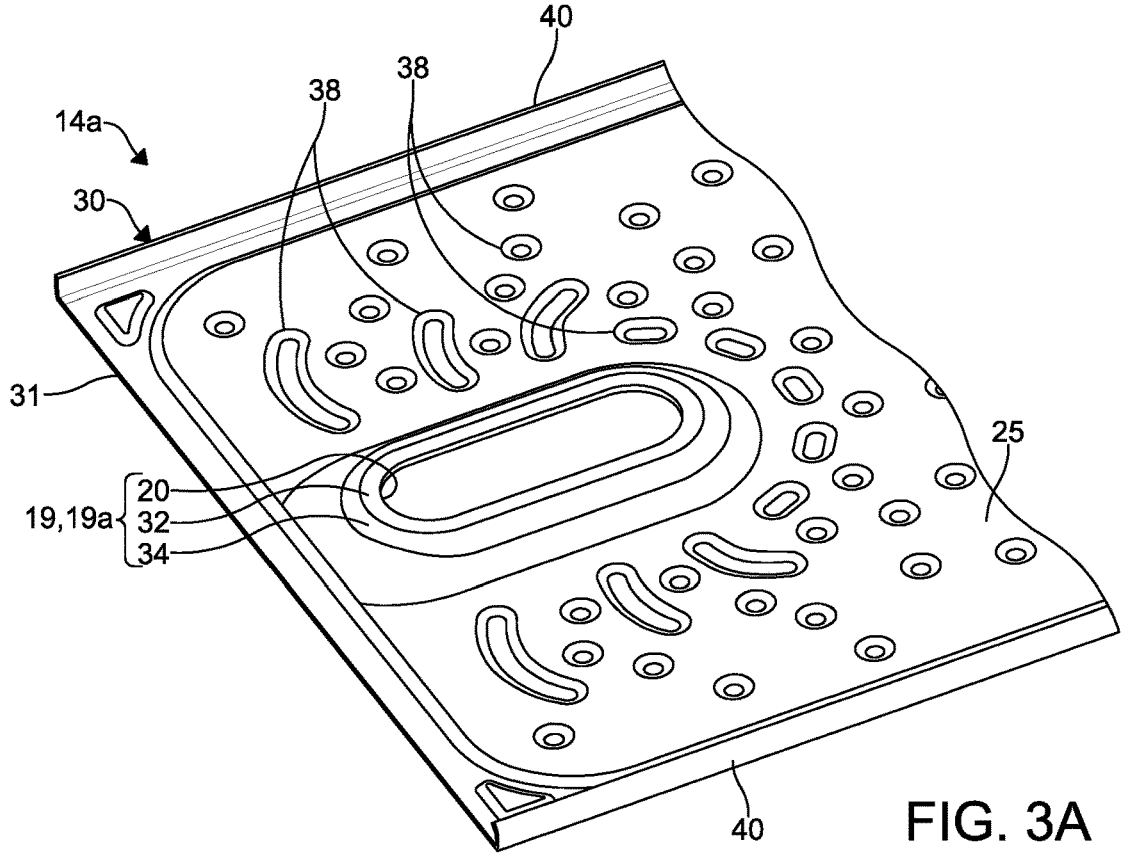
FIG. 3A is a fragmentary top perspective view of the first plate of FIG. 2.
Figure 3B:
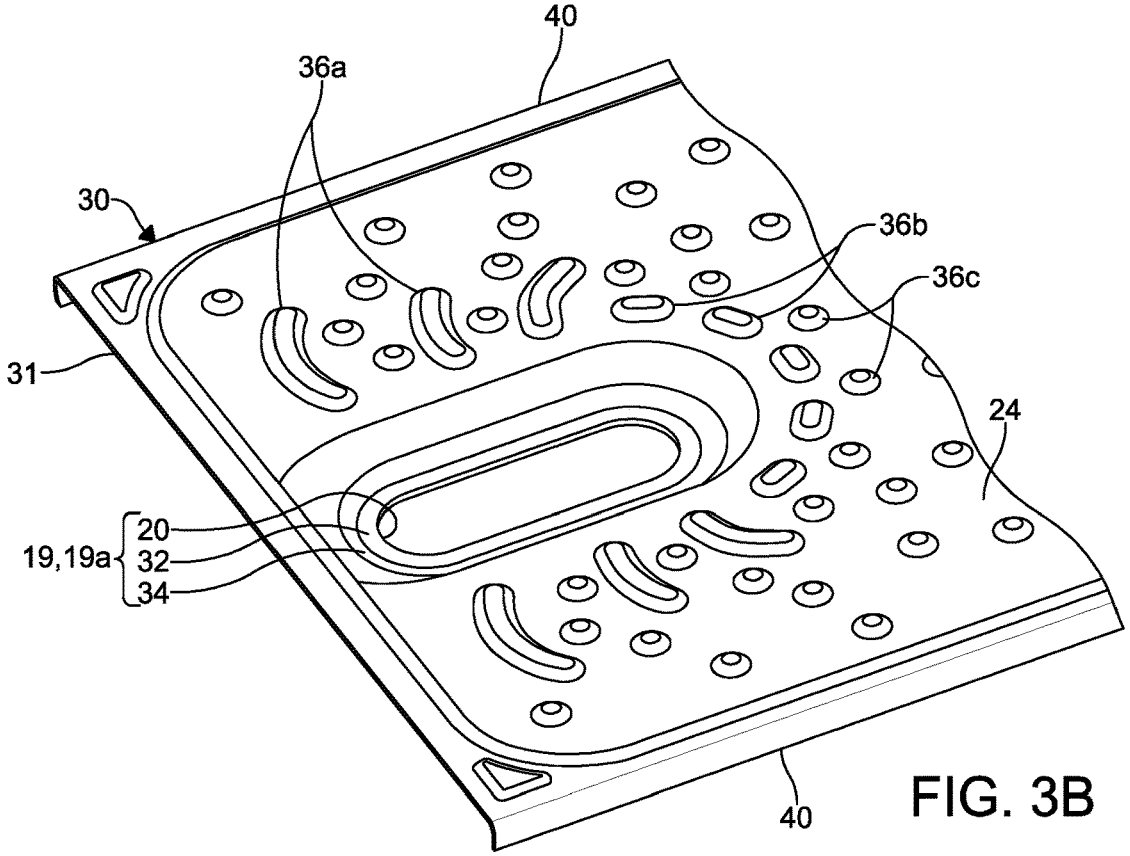
FIG. 3B is a fragmentary bottom perspective view of the first plate of FIG. 2.

FIGS. 2-3B illustrate the first plate 14*a* of the plate assemblies 14 for reference, However, it should be understood, while not shown or referenced, the second plate 14*b* is substantially the same as the first plate 14*a*. In assembly, the plates 14*a*, 14*b* are arranged in opposite directions from each other, wherein the plates 14*a*, 14*b* are mirror images of each other. Accordingly, the description used herein to describe the first plate 14*a* also substantially describes the second plate 14*b* unless otherwise indicated.

The plate 14*a* includes a substantially planar, rectangular body 30 having the fluid surface 24 for forming a portion of the flow channel 18 and the outer surface 25 for engaging the fins 16. The body 30 is divided into aperture portions 30*a* including the cups 19 and a transitional portion 30*b* disposed intermediate the aperture portions 30*a* or at portions of the body 30 not including the cups 19. A division between the portions 30*a*, 30*b* is schematically indicated with widthwise dashed lines. As used herein, the term "substantially" means "mostly, but not perfectly" or "approximately" as a person skilled in the art would recognize in view of the specification and drawings. The body 30 may include surface or coupling features (such as the collar 34, protrusions 36 described in further detail herein below, or an edge) extending outwardly from the surfaces 24, 25 thereof. However, as shown, a thickness of the body independent from the coupling or surface features is substantially constant along a length or a width of the plate 14*a*.

Figure 4:
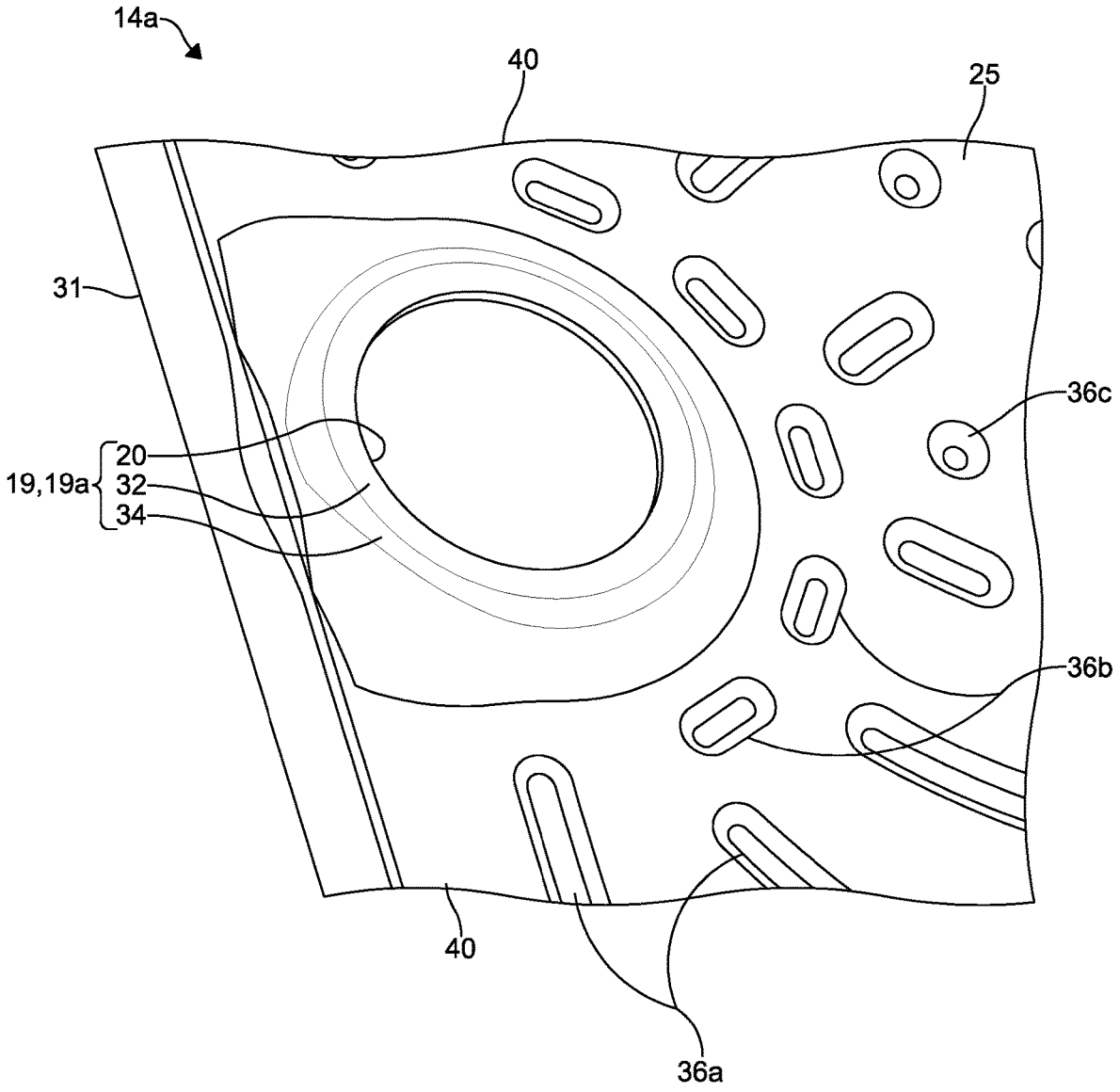
FIG. 4 is an enlarged fragmentary top perspective view of a first plate according to another embodiment of the disclosure.

A pair of the cups 19, a first cup 19*a* and a second cup 19*b*, is formed adjacent opposing lengthwise ends 31 of the plate 14*a* in the aperture portions 30*a* of the body 30. As shown in FIGS. 2-3B, the cups 19 have an obround cross-sectional shape, wherein two semi-circular ends are connected by a pair of linear portions. However, in another embodiment illustrated in FIG. 4, the cups 19 have a substantially circular cross-sectional shape. It is understood, other cross-sectional shapes of the cups 19 can be contemplated as desired. The first cup 19*a* is configured as an outlet cup and the second cup 19*b* is configured as an inlet cup.

An outer perimeter of each of the cups 19 is defined by the collar 34. The planar rim 32 is formed parallel to and spaced apart from the outer surface 25 of the plate 14*a*. The collar 34 connects the rim 32 to the plate 14*a*. The collar 34 has an arcuate convex surface with respect to the body 30. As more clearly shown in FIGS. 3A-4, a radius of the collar 34 may be variable. Particularly, the radius of the collar 34 may gradually decrease in an inward direction from the adjacent one of the ends 31 of the plate 14*a* towards an inner end of the collar 34. The variable radius of the collar 34 minimizes shear stresses in the plates 14*a* during intermittent cycling of the coolant system 2. Specifically, it has been discovered that the variable radius provides a 15% reduction in stress compared to plates having collars with a constant radius. However, it is understood the collar 34 can be substantially planar, if desired.

A plurality of protrusions 36 extends outwardly from the fluid surface 24 of the plate 14*a*. The protrusions 36 form a plurality of indentations 38 corresponding in shape to the protrusions 36 on the outer surface 25 of each of the plates 14*a* due to the forming process such as a stamping or molding process. However, it is understood, the protrusions 36 can be formed without the indentations 38 depending on the forming process used to produce the protrusions 36.

In the illustrated embodiment, the protrusions 36 include guiding protrusions 36*a*, restricting protrusions 36*b*, and turbulating protrusions 36*c*. The guiding protrusions 36*a* and the restricting protrusions 36*b* are formed about a perimeter of each of the cups 19 and aligned in an arcuate arrangement. The plurality of turbulating protrusions 36*c* is distributed one of evenly or irregularly across the fluid surface 24 of the plate 14*a*, 14*b*. For example, the aperture portions 30*a* of the body 30 include irregularly distributed ones of the turbulating protrusions 36*c* and the transitional portion 30*b* of the body 30 includes evenly distributed ones of the turbulating protrusions 36*c*.

The guiding protrusions 36*a* are elongated protrusions extending radially outwardly from each of the cups 19 towards sides 40 of the plate 14*a*. The guiding protrusions 36*a* extend in an arcuate shape, wherein each of the guiding protrusions 36*a* curves in a convex manner with respect to the opposing one of the cups 19. The guiding protrusions 36*a* are configured to direct the flow of the coolant towards the cups 19. The guiding protrusions 36*a* may be progressively sized, wherein arc lengths of successive ones of the guiding protrusions 36*a* are reduced as a distance from the adjacent one of the ends 31 of the plate 14*a* increases. Progressively sizing the guiding protrusions 36*a* minimizes an obstruction of the coolant flowing proximate the ends 31 of the plate and maximizes an even coolant flow distribution across an entirety of the plate 14*a*. In the embodiment illustrated, six guiding protrusions 36*a* are formed on the fluid surface 24. However, it is understood more than six or fewer than six of the guiding protrusions 36*a* can be formed on the fluid surface 24, if desired. The guiding protrusions 36*a* of the first plate 14*a* align with and engage the guiding protrusions 36*a* of the second plate 14*b* to define flow paths within the flow channel 18 when stacked together to form the plate assembly 14. The engagement of the guiding protrusions 36*a* of the first plate 14*a* with the guiding protrusions 36*a* of the second plate 14*b* militates against coolant flowing therethrough and directs the coolant to flow through the flow paths as desired. The guiding protrusions 36*a* of the first plate 14*a* are configured for coupling to the guiding protrusions 36*a* of the second plate 14*b* by a brazing process, for example. However, the guiding protrusions 36*a* of the plates 14*a*, 14*b* can be coupled to each other by other known processes as desired.

The restricting protrusions 36*b* are formed adjacent each of the cups 19 and circumscribe the inner semicircular end of each of the plates 19. The restricting protrusions 36*b* are configured to minimize a direct flow of the coolant flowing between each of the cups 19. In the embodiment illustrated, the restricting protrusions 36*b* have an obround cross-sectional shape. However, other shapes of the restricting protrusions 36*b* will be appreciated by those skilled in the art. As shown, five of the restricting protrusions 36*b* are formed on the fluid surface 24 of the plate 14*a*. However, it is understood more than five or fewer than five of the restricting protrusions 36*b* can be formed on the fluid surface 24 of the plate 14*a*, if desired. The restricting protrusions 36*b* of the first plate 14*a* align with and engage the restricting protrusions 36*b* of the second plate 14*b* to define the flow paths within the flow channel 18 when stacked together to form the plate assembly 14. The engagement of the restricting protrusions 36*b* of the first plate 14*a* to the restricting protrusions 36*b* of the second plate 14*b* directs the coolant to flow about the restricting protrusions 36*b*. The restricting protrusions 36*b* of the first plate 14*a* are configured for coupling to the restricting protrusions 36*b* of the second plate 14*b* by a brazing process, for example. Although, the restricting protrusions 36*b* of the plates 14*a*, 14*b* can be coupled to each other by other known process, as desired. In another embodiment, the restricting protrusions 36*b* of the first plate 14*a* can align with but not engage the restricting protrusions 36*b* of the second plates 14*b*, wherein the coolant can minimally flow between the restricting protrusions 36*b* of the first plate 14*a* and the restricting protrusions 36*b* of the second plate 14*b*.

The turbulating protrusions 36*c* are configured to cause a turbulent flow of the coolant across and around the turbulating protrusions 36*c*, particularly as the coolant flows between the cups 19. The turbulating protrusions 36*c* have a circular cross-sectional shape. However, other shapes of turbulating protrusions 36*c* will be appreciated by those skilled in the art. In one embodiment, the turbulating protrusions 36*c* are configured as dimples minimally extending from the fluid surface 24, wherein the turbulating protrusions 36*c* do not engage the turbulating protrusions 36*c* of the second plate 14*b*. Each of the turbulating protrusions 36*c* can extend from the fluid surface 24 at substantially the same height or the turbulating protrusions can extend from the fluid surface 24 at various heights. It is understood, the turbulating protrusions 36*c* of the first plate 14*a* can be aligned with or misaligned with the turbulating protrusions 36*c* of the second plate 14*b*. In another embodiment, a portion of the turbulating protrusions 36*c* of the first plate 14*a* are configured for engagement with the tubulating protrusions 36*c* of the second plate 14*b*.

Figure 5:
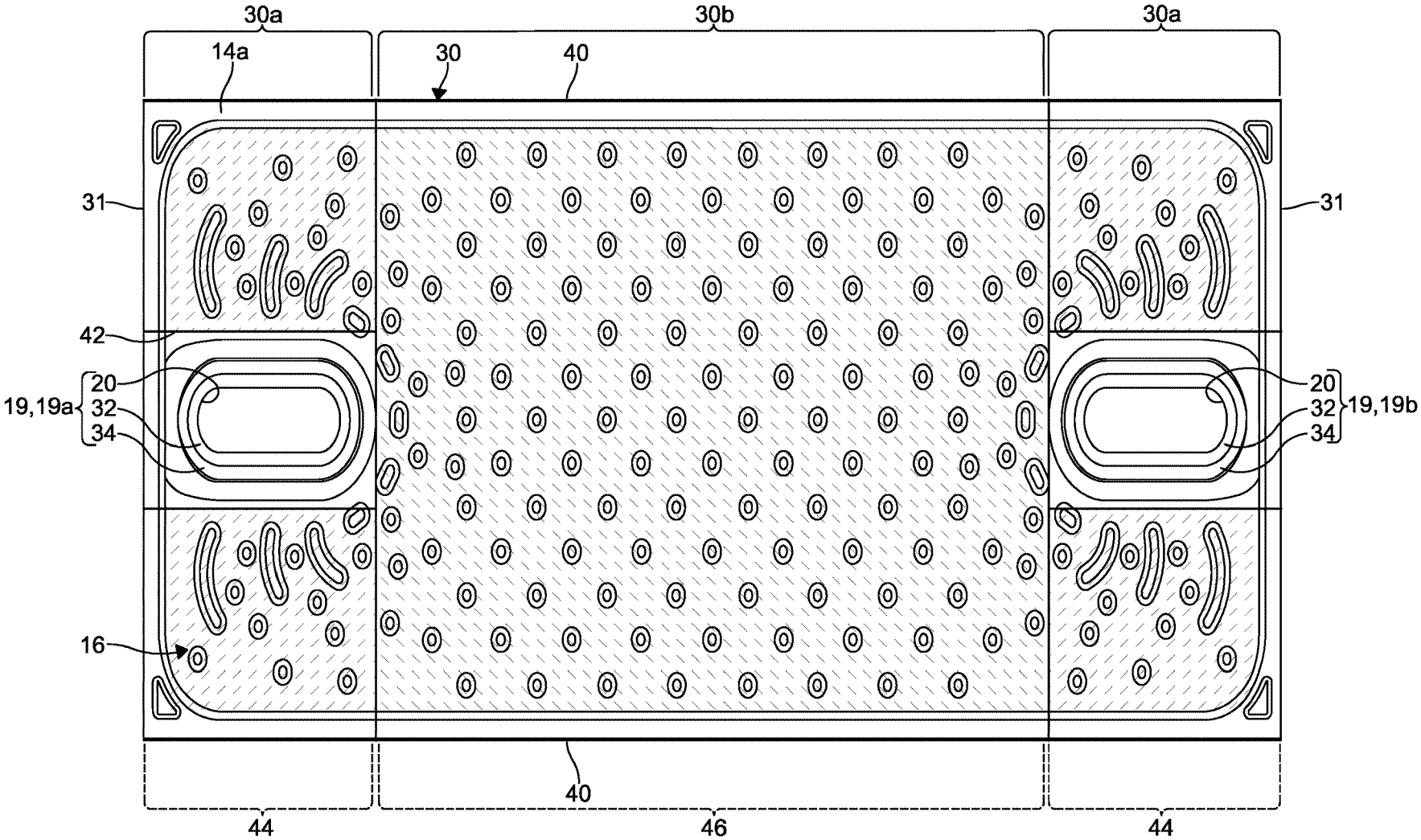
FIG. 5 is a top plan view of the first plate of the plate assembly of FIGS. 1-3B with a schematic representation of a fin of the heat exchange core of FIG. 1 overlaying the first plate, wherein the fin is illustrated by dashed diagonal lines.

FIG. 5 illustrates the plate 14*a* with a schematic outline representation of one of the fins 16 (indicated by the slanted lines) overlying and engaging the outer surface 25 of the plate 14*a*. The fin 16 engages almost an entirety of the outer surface 25, including the aperture portions 30*a* of the surface 25 between the cups 19 and the sides 40 of the plate 14*a*. The fin 16 includes cutout portions 42 configured to expose the cups 19 and accommodate the rim 32 and the collar 34. The cutout portions 42 permit the rims 32 to extend through the cutout portions 42, wherein the rims 32 of the first plate 14*a* can engage the rims 32 of the second plate 14*b* to form the plate assembly 14 without obstruction from the fin 16. With the cutout portions 42, the fin 16 is permitted to extend substantially the entire length of the outer surface 25 and engage the aperture portions 30*a* of the outer surface 25 between the cups 19 and the sides 40 of the plate 14*a*. Advantageously, the fin 16 facilitates maximized heat transfer between the coolant and the air flowing through the heat exchanger 10 and provides maximized structural support for the plate assemblies 14 when stacked together.

In the embodiment illustrated, the fin 16 includes a non-louvre fin region 44 and a louvre fin region 46. The non-louvre fin region 44 (indicated by lines slanting downwardly from right to left) includes portions of the fin 16 without louvres formed on a surface thereof. However, it is understood, other surface features such as windows can be formed through the surface of the fins 16 of the non-louvre fin region 44. The louvre fin region 46 (indicated by lines slanting downwardly from left to right) includes portions of the fin 16 with louvres 48 (shown in FIG. 11) formed on a surface thereof. The non-louvre fin region 44 corresponds to and aligns with the aperture portions 30*a* of the first plate 14*a*. The non-louvre fin region 44 extends along the width of the plate 14*a* from adjacent one side 40 of the plate 14*a* to adjacent the other side 40 of the plate 14*a* at portions of the plate 14*a* including the cups 19 and at a length substantially equal to a length of the cups 19. The louvre fin region 46 corresponds to and aligns with the transitional portion 30*b* of the first plate 14*a*. The louvre fin region 46 extends along the remaining portion of the fin 16 that does not include the non-louvre fin region 44. For example, the louvre fin region 46 extends along the width of the plate 14*a* from adjacent one side 40 of the plate 14*a* to adjacent the other side 40 of the plate 14*a* and at lengths of the plate 14*a* not including the cups 19.

Figure 11:
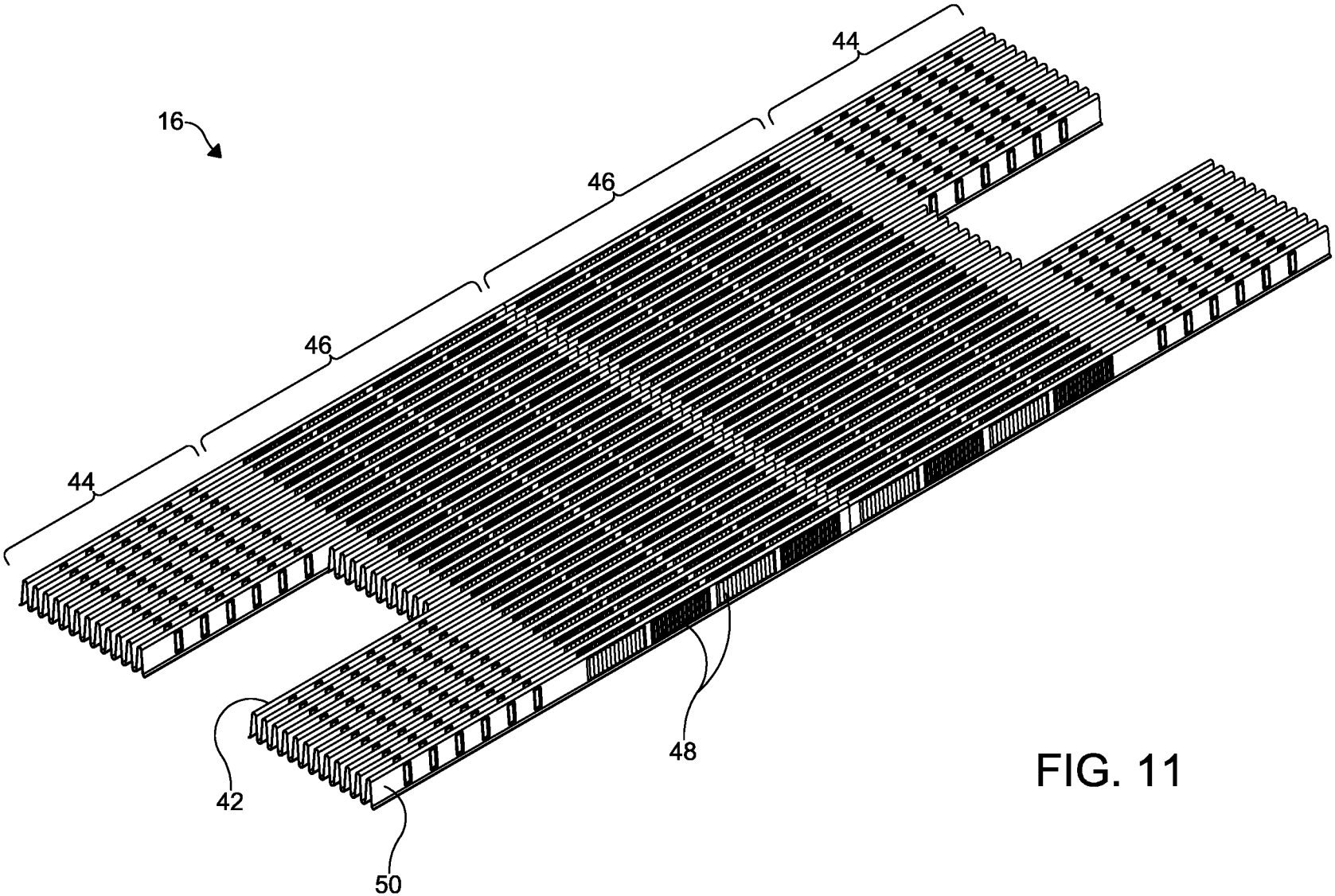
FIG. 11 is a fragmentary top perspective view of a fin of the heat exchange core of FIG. 1.

FIG. 11 illustrates an embodiment of the fin 16 to illustrate sections of the non-louvre fin region 44, the louvre fin region 46, and the cutout portions 42 in further detail. The fin 16 is formed from a continuous corrugated sheet and includes the non-louvre fin region 44, the louvre region 46 with the louvres 48 formed on walls 50 thereof, and the cutout portions 42. The fin 16 can be formed integrally from one unitary fin unit. However, in another embodiment, the fin 16 can be formed from two separate substantially identical fin units joined together or engaging at a center of the fin 16 with respect to the length of the fin 16.

Figure 6:
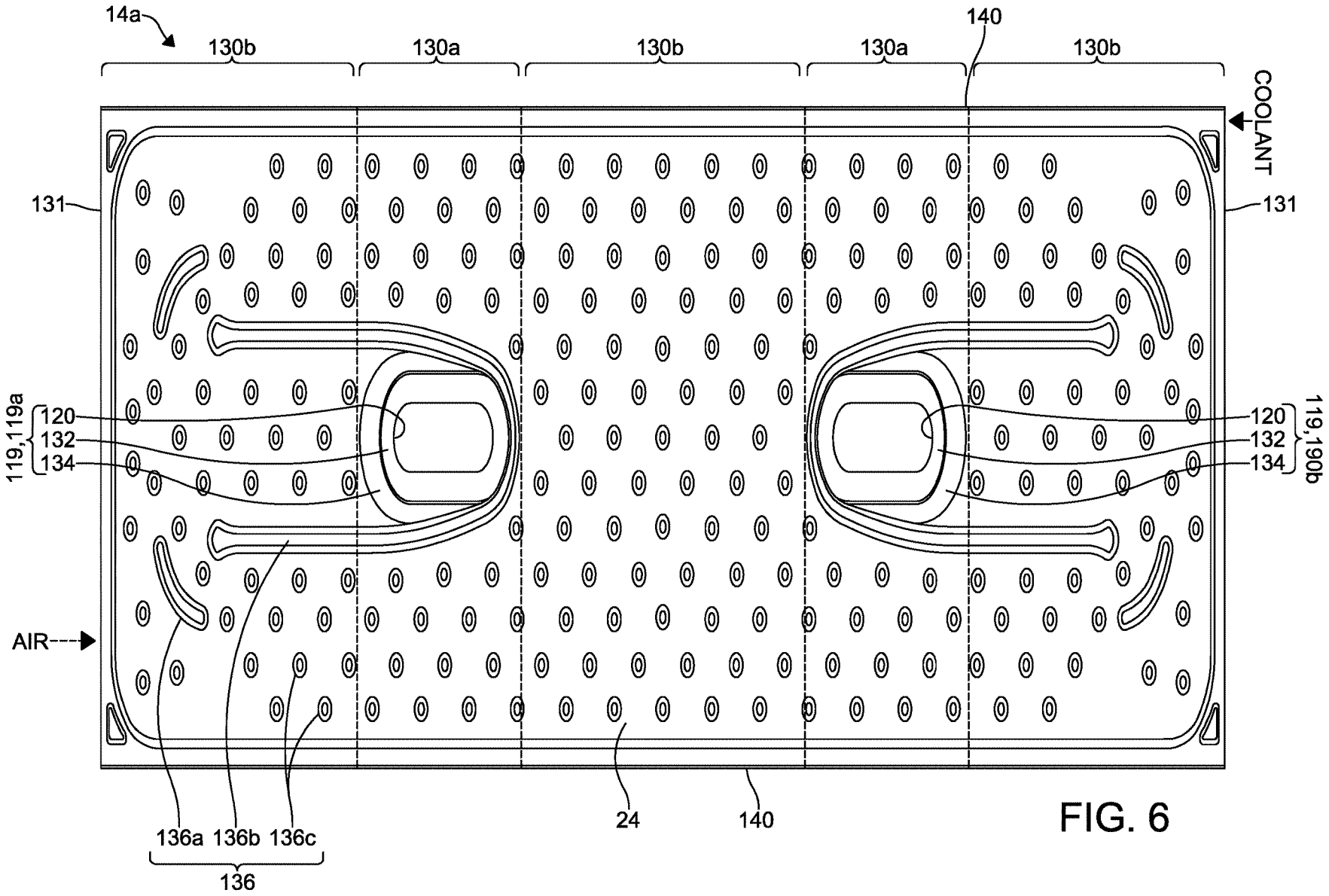
FIG. 6 is a top plan view of a first plate according to another embodiment of the disclosure.

FIG. 6 illustrates a plate 114*a* according to another embodiment of the disclosure. Features of the plate 114*a* of FIG. 6 similar to the features of the plate 14*a* of FIGS. 1-5 are denoted with the same reference numerals except with a leading one "1" for reference.

The plate 114*a* is similar to the plate 14*a* of FIGS. 1-5 except the cups 119 are spaced from the ends 131 of the plate 114*a*. For example, the cups 119 are spaced at a distance from the ends 131 at a distance equal to or greater than a length of the cups 119 or a distance equal to or greater than a quarter of the length of the plate 114*a*. Although, the cups 119 can be spaced from the ends 131 at any distance as desired. Advantageously, a distance between the cups 119 is minimized. As a result, thermal stresses and deformations caused by thermal expansion are minimized especially at an air inlet end of the plate 114*a*. The spacing of the cups 119 from the ends 131 advantageously improves a structural integrity of the plate 114*a* adjacent the ends 131 of the plate 114*a*.

The plate 114*a* includes the guiding protrusions 136*a* and the restriction protrusions 136*b*. However, the guiding protrusions 136*a* are disposed intermediate the cups 119 and the ends 131 of the plate 114*a*. The restriction protrusions 136*b* are continuous and extend in a substantially U-shaped pattern with a closed end facing a center portion of the plate 114*a* and open ends facing the ends 131 of the plate 114*a*. As shown, a pair of the guiding protrusions 136*a* is formed at both ends 131 of the plate 114*a*, wherein each of the guiding protrusions 136*a* are disposed about the open ends of the restriction protrusions 136*b*. The guiding protrusions 136*a* are configured to guide the flow of the coolant between the cups 119. The restriction protrusions 136*b* militate against a direct flow of the coolant between the cups 119.

Figure 7:
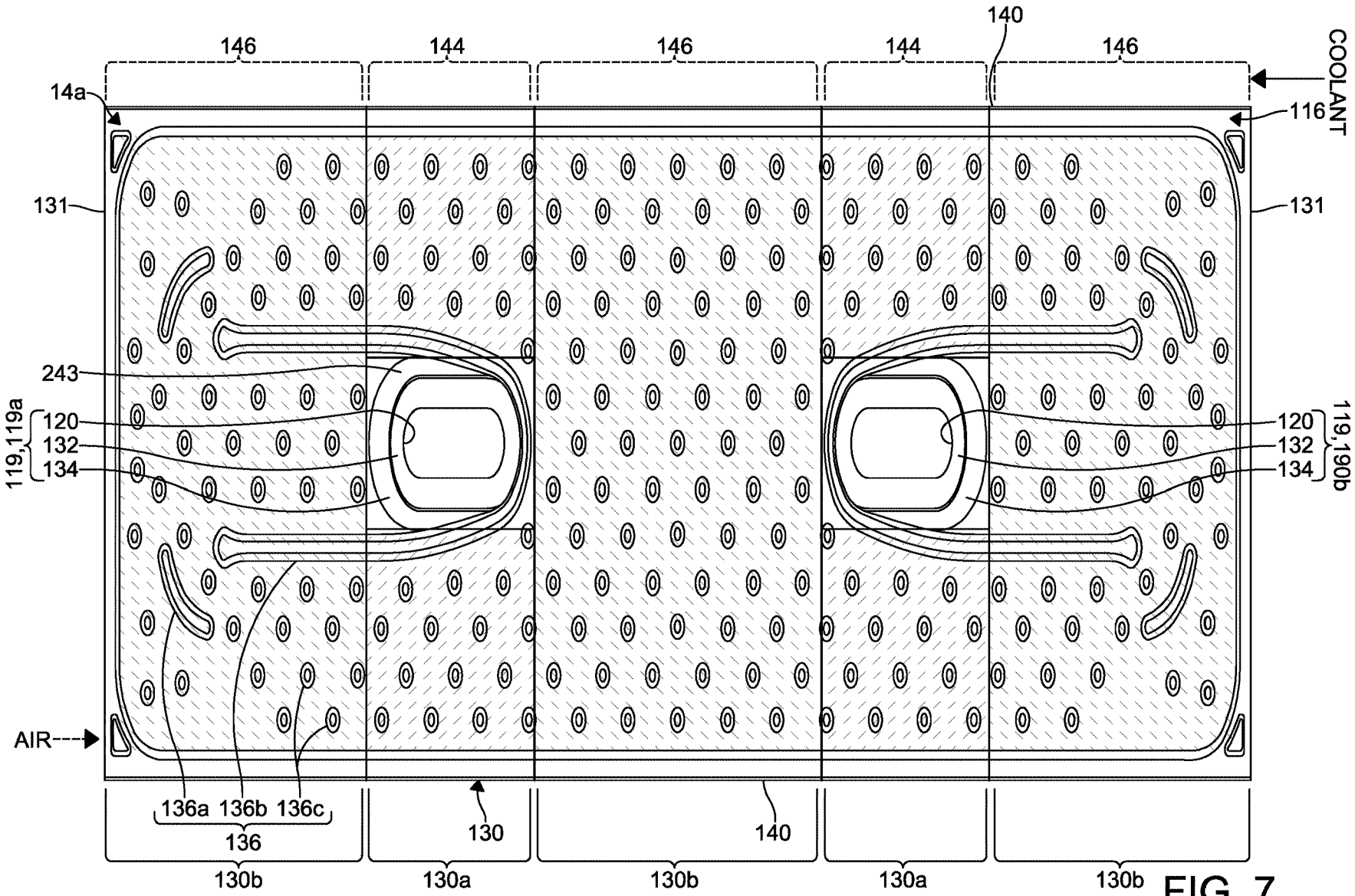
FIG. 7 is a top plan view of the first plate of FIG. 6 with a schematic representation of a fin according to another embodiment of the disclosure overlying the first plate, wherein the fin is illustrated by dashed diagonal lines.

FIG. 7 is a schematic illustration of a fin 116 according to another embodiment of the disclosure overlaying and engaging the plate 114*a*. The fin 116 of FIG. 7 is substantially similar to the fin 16 of FIGS. 5 and 11. Features of the fin 116 of FIG. 7 similar to the features of the fin 16 of FIGS. 5 and 11 are denoted with the same reference numerals except with a leading one "1" for reference. The fin 116 includes the non-louvre fin region 144 and the louvre fin region 146. The louvre fin region 146 corresponds to and aligns with the transitional portions 130*b* of the first plate 114*a*. In the embodiment illustrated, the louvre fin region 146 extends along the length of the plate 114*a* intermediate the cups 119 and along the width of the plate 114*a* intermediate the sides 140 of the plate 114*a*, 114*b*. However, according to this embodiment, the louvre fin region 146 also extends intermediate each of the ends 131 of the plate 114*a* and the cups 119 to accommodate for the cups 119 spaced from the ends 131 of the plate 114*a*. The non-louvre fin region 144 corresponds to and aligns with the aperture regions 130*a* of the first plate 114*a*. The non-louvre fin region 144 extends along the width of the plate 114*a* intermediate the sides 140 of the plate 114*a* at the aperture portions 130*a* of the plate 114*a* at a length substantially equal to the length of the cups 119.

Figure 8:
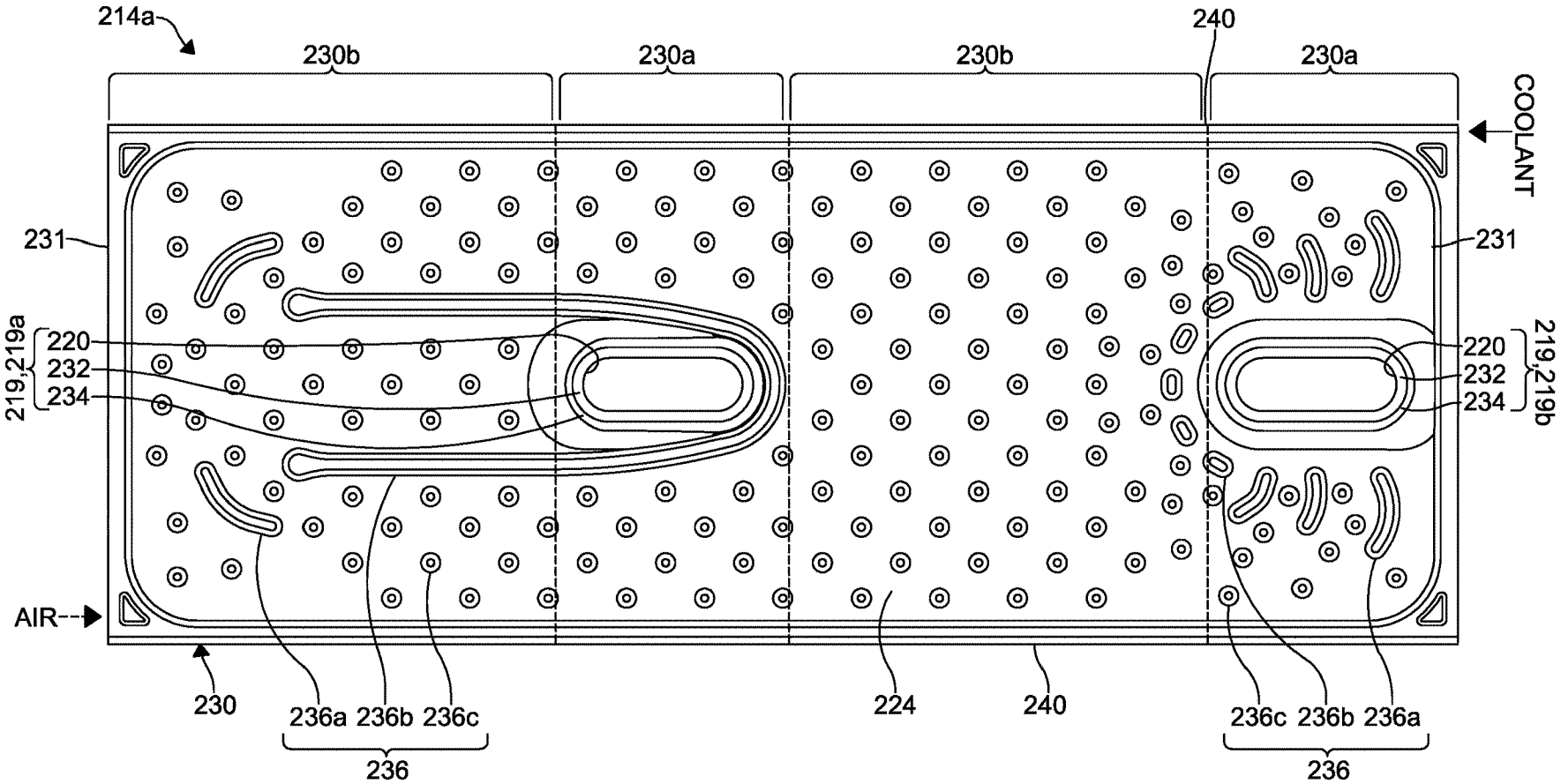
FIG. 8 is a top plan view of a first plate according to another embodiment of the disclosure.

FIG. 8 illustrates a plate 214*a* according to another embodiment of the disclosure. Features of the plate 214*a* of FIG. 8 similar to the features of the plate 14*a*, 114*a* of FIGS. 1-7 are denoted with the same reference numerals except with a leading two "2" for reference. The plate 214*a* is similar to the plate 14*a*, 114*a* of FIGS. 1-7 except the first cup 19*a* is spaced from a corresponding one of the ends 231 of the plate 214*a* similar to the cups 119 of FIG. 6. The second cup 219*b* is formed directly adjacent a corresponding one of the ends 231 similar to the cups 19 of FIGS. 1-5. The plates 14*a*, 114*a* of FIGS. 1-7 are symmetric about a widthwise axis extending through a center of the length l of the plate 14*a*, 114*a*. However, the plate 214*a* of FIG. 8 is asymmetric about the widthwise axis extending through the center of the length of the plate 214*a*.

Figure 9:
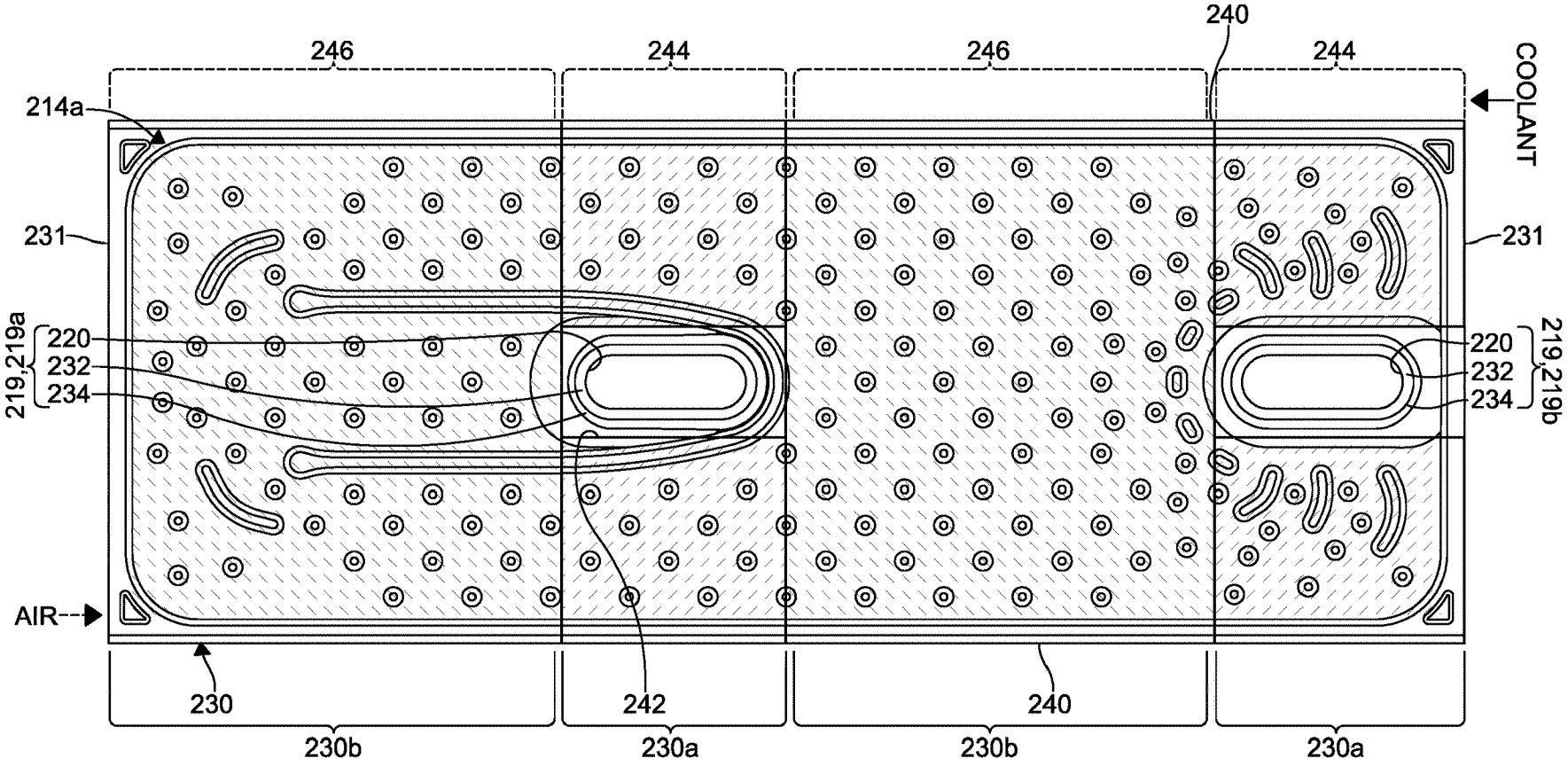
FIG. 9 is a top plan view of the first plate of FIG. 8 with a schematic representation of a fin according to another embodiment of the disclosure overlying the first plate, wherein the fin is illustrated by dashed diagonal lines.

FIG. 9 is a schematic illustration of a fin 216 according to another embodiment of the disclosure overlaying and engaging the plate 214*a* of FIG. 8. The fin 216 of FIG. 9 is substantially similar to the fin 16 of FIGS. 5 and 11 and the fin 116 of FIG. 7. Features of the fin 216 of FIG. 9 similar to the features of the fin 16 of FIGS. 5 and 11 and the fin 116 of FIG. 7 are denoted with the same reference numerals except with a leading one "2" for reference. The fin 216 includes the non-louvre fin region 244 and the louvre fin region 246. The louvre fin region 244 corresponds to and aligns with the transitional portion 230*b* of the first plate 214*a*. In the embodiment illustrated, the louvre fin region 246 extends along the length of the plate 214*a* intermediate the cups 219 and along the width of the plate 214*a* intermediate the sides 240 of the plate 214*a*, 214*b*. However, according to this embodiment, the louvre fin region 246 also extends intermediate the first cup 219*a* and the corresponding one of the ends 231. The non-louvre fin region 244 corresponds to and aligns with the aperture regions 230*a* of the first plate 214*a*. The non-louvre fin region 244 extends along the width of the plate 214*a* intermediate the sides 240 of the plate 214*a* at the aperture regions 230*a* of the plate 214*a* and at a length substantially equal to the length of the cups 219.

Figure 10A:
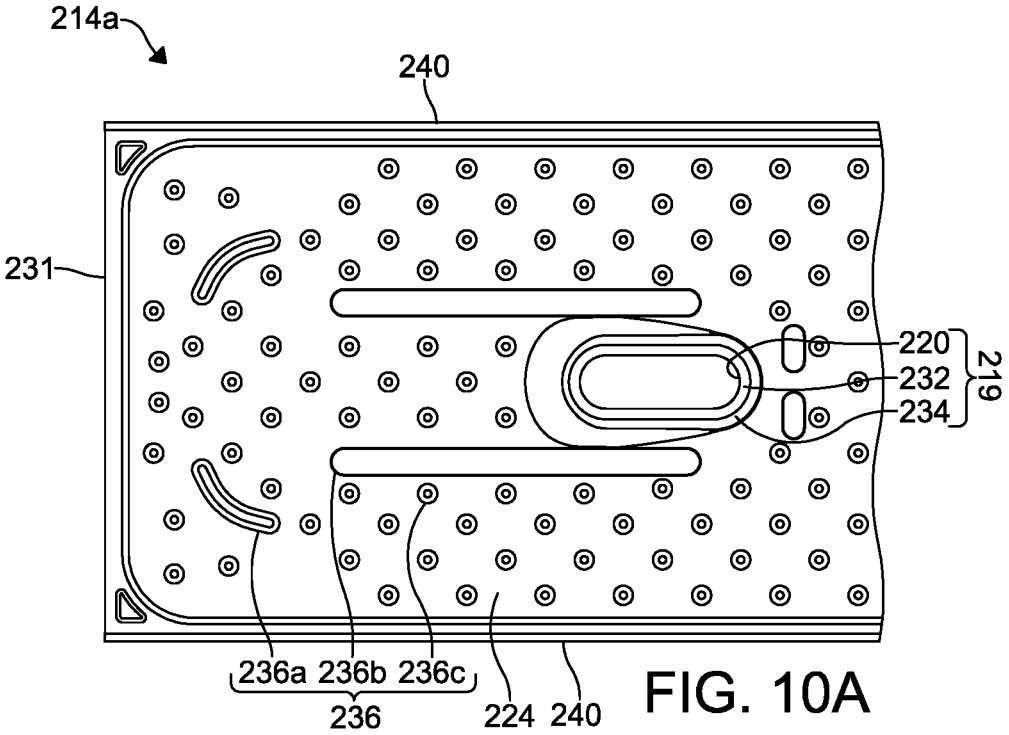
FIGS. 10A-10B are fragmentary top plan views of the first plate of FIG. 8 illustrating schematic restriction protrusions according to other embodiments of the disclosure.
Figure 10B:
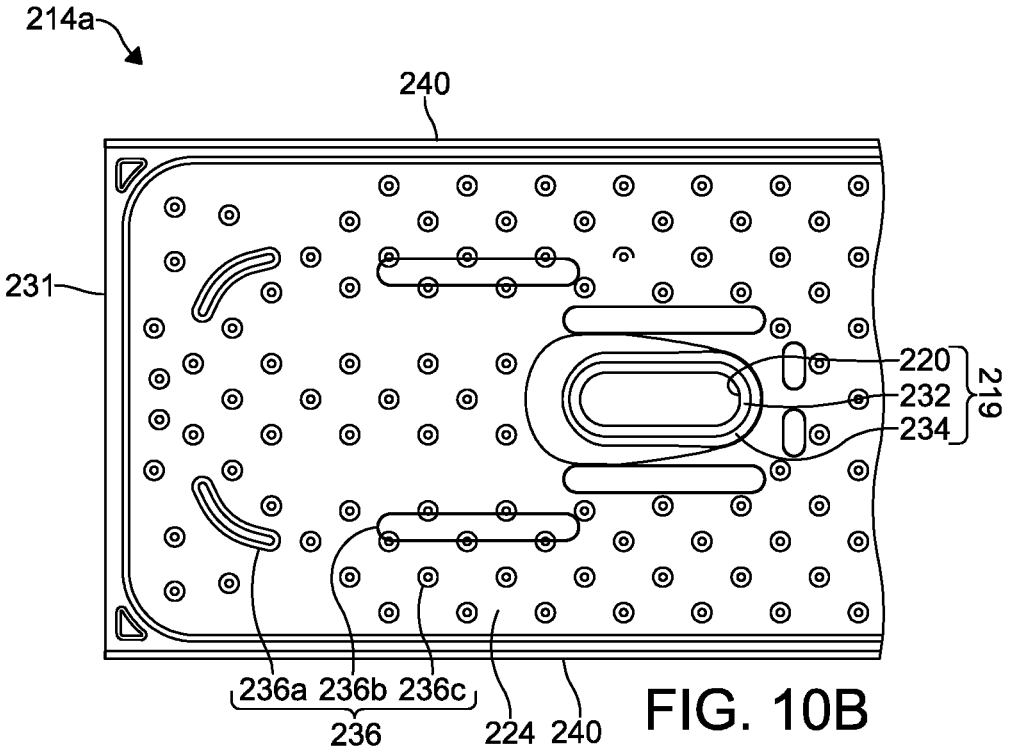

FIGS. 10A-10B illustrate alternate schematic embodiments of the restricting protrusions 236*b* of the plate 214*a*. In the embodiment illustrated in FIG. 10A, the restricting protrusions 236*b* are segmented including a pair of elongate portions each on a widthwise side of the cups 219 and a pair of ovular portions adjacent an inner end of the cups 219. In FIG. 10B, the restricting protrusions 236*b* are segmented to include four elongate portions. A first pair of the elongate portions are disposed each on a widthwise side of the cups 219 and a second pair of the elongate portions staggered from the first pair of elongate portions in both a widthwise direction and a lengthwise direction. The restricting protrusions 236*b* also include a pair of ovular portions adjacent an inner end of the cups 219. The segmented restricting protrusions 236*b* define spaces in which a minimal amount of flow of the coolant may flow through the restricting protrusions 236*b* directly to the cups 219 instead of completely around the restricting protrusions 236*b* if necessary, depending on the application.

To assemble, the first plate 14*a*, 114*a*, 214*a* engages the second plate 14*b*, 114*b*, 214*b* to form the plate assemblies 14. In engagement, the fluid surface 24, 124, 224 of the first plate 14*a*, 114*a*, 214*a* faces the fluid surface 24, 124, 224 of the second plate 14*b*, 114*b*, 214*b*, wherein the first cups 19*a*, 119*a*, 219*a* of the first plate 14*a*, 114*a*, 214*a* align with the first cups 19*a*, 119*a*, 219*a* of the second plate 14*b*, 114*b*, 214*b* and the second cups 19*b*, 119*b*, 219*b* of the first plate 14*a*, 114*a*, 214*a* align with the second cups 19*b*, 119*b*, 219*b* of the second plate 14*b*, 114*b*, 214*b*. The rims 32, 132, 232 of the first plate 14*a*, 114*a*, 214*a* engage the rims 32, 132, 232 of the second plate 14*b*, 114*b*, 214*b*. The protrusions 36, 136, 236 of the first plate 14*a*, 114*a*, 214*a* engage the protrusions 36, 136, 236 of the second plate 14*b*, 114*b*, 214*b* to form the flow channel 18.

In application, the air flows through the heat exchanger 10 and through the fins 16, 116, 216 in a direction substantially parallel to the lengthwise direction of the plate 14*a*, 14*b*, 114*a*, 114*b*, 214*a*, 214*b* or a general direction of the flow of coolant between the manifolds 22 through the plate assemblies 14. The coolant naturally flows through the flow channel 18 in a direction substantially parallel to the direction of the flow of air through the heat exchanger 10 between the manifolds 22. The protrusions 36, 136, 236 may cause the coolant to flow thereabout, and thus in a direction non-parallel to the direction of the flow of air through the heat exchanger 10. As a result, heat transfer is maximized.

Advantageously, the heat exchanger 10 according to the present disclosure maximizes structural integrity of the heat exchanger 10 and maximizes heat transfer efficiency during intermittent cycling of the coolant system 2.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A plate for a heat exchanger comprising:

a substantially planar body having a first end, a second end opposing the first end, a fluid surface, and an outer surface, wherein a plurality of protrusions extends from the fluid surface;

a first cup extending outwardly from the outer surface of the body and spaced from the first end of the body; and a second cup extending outwardly from the outer surface of the body adjacent the second end of the body, wherein the plurality of protrusions further comprise a plurality of guiding protrusions, a plurality of restricting protrusions, and a plurality of turbulating protrusions, the plurality of guiding protrusions configured to guide a flow of a coolant between the first cup and the second cup, the plurality of restricting protrusions configured to restrict the flow of the coolant between the first cup and the second cup, the plurality of turbulating protrusions configured to cause a turbulent flow of the coolant flowing between the first cup and the second cup, wherein the plurality of guiding protrusions is elongate and disposed about a perimeter of the second cup, wherein the plurality of guiding protrusions is disposed intermediate the second cup and a side of the body with respect to a width direction of the plate, wherein a first portion of the plurality of turbulating protrusions is disposed between adjacent ones of the plurality of guiding protrusions, wherein a second portion of the plurality of turbulating protrusions is disposed intermediate the first cup and the first end of the body, and wherein a cross-sectional shape of the turbulating protrusions is different from a cross-sectional shape of the guiding protrusions.

2. The plate of claim 1, wherein the first cup includes an aperture configured as an inlet aperture to convey a coolant from a coolant inlet of the heat exchanger to the plate, and wherein the second cup includes an aperture configured as an outlet aperture to convey the coolant from the plate to a coolant outlet of the heat exchanger.

3. A plate and fin assembly for a heat exchanger comprising:

a plate having a fluid surface, an outer surface, a first end, a second end, a first cup extending outwardly from the outer surface, and a second cup extending outwardly from the outer surface, wherein a plurality of protrusions extends outwardly from the fluid surface, the plurality of protrusions including a plurality of elongate guiding protrusions, a plurality of restricting protrusions, and a plurality of turbulating protrusions, the plurality of guiding protrusions configured to guide a flow of a coolant between the first cup and the second cup, the plurality of restricting protrusions configured to restrict the flow of the coolant between the first cup and the second cup, the plurality of turbulating protrusions configured to cause a turbulent flow of the coolant flowing between the first cup and the second cup, wherein the plurality of guiding protrusions is disposed about a perimeter of the first cup and the second cup, wherein the plurality of guiding protrusions is disposed intermediate the first cup and each of a pair of sides of the body and intermediate the second cup and each of the sides of the body with respect to a width direction of the plate, wherein a first portion of the plurality of turbulating protrusions is disposed between adjacent ones of the plurality of guiding protrusions, wherein a second portion of the plurality of turbulating protrusions is disposed intermediate the first cup and the first end of the body, and wherein a cross-sectional shape of the turbulating protrusions is different from a cross-sectional shape of the guiding protrusions; and a fin engaging the outer surface of the plate, the fin having a louvre region and a non-louvre region, the non-louvre region engaging the plate adjacent the first cup with respect to a width of the plate, the louvre region engaging the plate intermediate the first cup and the second cup with respect to a length of the plate.

4. The plate and fin assembly of claim 3, wherein the first cup includes an aperture configured as an inlet aperture to convey a coolant from a coolant inlet of the heat exchanger to the plate, wherein the second cup includes an aperture configured as an outlet aperture to convey the coolant from the plate to a coolant outlet of the heat exchanger, and wherein the plate is substantially planar.

5. The plate and fin assembly of claim 4, wherein the first cup is spaced from the first end of the plate and the second cup is spaced from the second end of the plate.

6. The plate and fin assembly of claim 4, wherein the first cup is spaced from the first end of the plate and the second cup is disposed adjacent the second end of the plate.

7. The plate and fin assembly of claim 3, wherein each of the first cup and the second cup has a collar, and wherein a radius of the collar is variable.

8. The plate and fin assembly of claim 3, wherein at least one of the plurality of restricting protrusions extends about a perimeter of one of the first cup and the second cup.

9. The plate and fin assembly of claim 3, wherein the plurality of guiding protrusions extends in an arcuate shape.

10. The plate and fin assembly of claim 3, wherein the first cup and the second cup each include a planar rim spaced from the outer surface of the plate and a collar extending outwardly from the outer surface of the plate and terminating at the planar rim.

11. The plate and fin assembly of claim 3, wherein the fin includes a first cutout portion configured to receive the first cup and a second cutout portion configured to receive the second cup.

12. The plate and fin assembly of claim 3, wherein the plate is symmetric about a widthwise direction extending through a center of a length of the plate.

13. The plate and fin assembly of claim 3, wherein the plate is asymmetric about a widthwise direction extending through a center of a length of the plate.

14. The plate and fin assembly of claim 3, wherein the non-louvre region is divided into a first non-louvre portion and a second non-louvre portion, wherein a first portion of the louvre region is disposed intermediate the first non-louvre portion and the second non-louvre portion.

15. The plate and fin assembly of claim 14, wherein the first portion of the louvre region engages the outer surface of the plate intermediate the first cup and the second cup and a second portion of the louvre region engages the outer surface of the plate intermediate the first cup and the first end.

16. A plate and fin assembly for a heat exchanger comprising:

a plate having a fluid surface, an outer surface, a first end, a second end, a first cup, and a second cup, the plate including a plurality of protrusions extending outwardly from the fluid surface of the plate, wherein the plurality of protrusions includes a plurality of elongate guiding protrusions formed adjacent each of the first cup and the second cup and configured to guide a flow of a coolant between the first cup and the second cup, wherein the plurality of protrusions includes a plurality of restricting protrusions configured to restrict the flow of the coolant between the first cup and the second cup, wherein the plurality of protrusions includes a plurality of turbulating protrusions configured to cause a turbulent flow of the coolant flowing between the first cup and the second cup, and wherein the plurality of guiding protrusions extends in an arcuate shape, the plurality of restricting protrusions is substantially U-shaped in cross-section, and the plurality of turbulating protrusions is substantially circular in cross-section, and wherein a first portion of the plurality of turbulating protrusions is disposed between adjacent ones of the plurality of guiding protrusions and disposed between the plurality of guiding protrusions and the plurality of restricting protrusions, and wherein a cross-sectional shape of the turbulating protrusions is different from a cross-sectional shape of the guiding protrusions; and a fin engaging the outer surface of the plate and including a first cutout portion and a second cutout portion, the first cutout portion receiving the first cup and the second cutout portion receiving the second cup.

17. The plate and fin assembly of claim 16, wherein the fin has a louvre region and a non-louvre region, the non-louvre region engaging the plate adjacent the first cup with respect to a width of the first cup, the louvre region engaging the plate intermediate the first cup and the second cup with respect to a length of the plate.

* * * * *